US007661966B2

(12) United States Patent
Ohanesian

(10) Patent No.: US 7,661,966 B2
(45) Date of Patent: Feb. 16, 2010

(54) ELECTRICAL POWER, COMMUNICATION AND DATA CABLE MANAGEMENT SYSTEMS

(75) Inventor: Harout Ohanesian, Guilford (GB)

(73) Assignee: Interplast Co., Limited, Sharjah (AE)

( * ) Notice: Subject to any disclaimer, the term of this patent is extended or adjusted under 35 U.S.C. 154(b) by 227 days.

(21) Appl. No.: 10/581,694

(22) PCT Filed: Dec. 6, 2004

(86) PCT No.: PCT/IB2004/004327

§ 371 (c)(1),
(2), (4) Date: Apr. 23, 2008

(87) PCT Pub. No.: WO2005/057736

PCT Pub. Date: Jun. 23, 2005

(65) Prior Publication Data

US 2008/0214030 A1 Sep. 4, 2008

(30) Foreign Application Priority Data

Dec. 6, 2003 (GB) ..... 0328247.2
Mar. 1, 2004 (GB) ..... 0404479.8

(51) Int. Cl.
*H01R 25/00* (2006.01)

(52) U.S. Cl. ..... 439/120; 439/650

(58) Field of Classification Search ..... 439/110–121, 439/209, 217–223, 650–655
See application file for complete search history.

(56) References Cited

U.S. PATENT DOCUMENTS 5,418,328 A 5/1995 Nadeau
5,603,621 A 2/1997 Elmouchi
5,688,132 A * 11/1997 Rogers et al. ..... 439/120
5,759,051 A 6/1998 Cancellieri et al.
6,309,229 B1 10/2001 Sinclair
7,094,077 B1 * 8/2006 Chen ..... 439/118
7,201,589 B2 * 4/2007 Jong ..... 439/94
7,367,821 B2 * 5/2008 Leslie et al. ..... 439/121
7,381,064 B2 * 6/2008 Bolen et al. ..... 439/67
7,438,566 B2 * 10/2008 Chen ..... 439/110
7,470,861 B1 * 12/2008 Ross et al. ..... 174/95
2007/0218720 A1 * 9/2007 Jong ..... 439/120
2008/0214030 A1 * 9/2008 Ohanesian ..... 439/110
2008/0302553 A1 * 12/2008 Ross et al. ..... 174/95

FOREIGN PATENT DOCUMENTS

DE 19932561 2/2001
EP 0159556 10/1985
FR 2837323 9/2003

* cited by examiner

*Primary Examiner*—James Harvey
(74) *Attorney, Agent, or Firm*—King & Schickli, PLLC

(57) ABSTRACT

According to a first aspect of the invention there is provided an electrical distribution system (1) comprising or including an insulating track (4) for insulating an electrically conducting track (5) connectable to an electric power supply, one or more electric power take off sockets (2), each for receiving in electrical contact therewith an electric plug when inserted therein, characterized in that the or each socket (2) has electrical contacts (48, 49 and 50) engageable via a push fit with a slideable carriage (23) electrically connectable to the electrically conducting track (5) and being adapted to slide therealong, and locking means (32, 33) whereby the or each socket may be selectably locked in place along the electrically conductive track, thereby to position and re-position as required said the or each electric power take off socket.

11 Claims, 12 Drawing Sheets

ELECTRICAL POWER, COMMUNICATION AND DATA CABLE MANAGEMENT SYSTEMS

Figure 1:
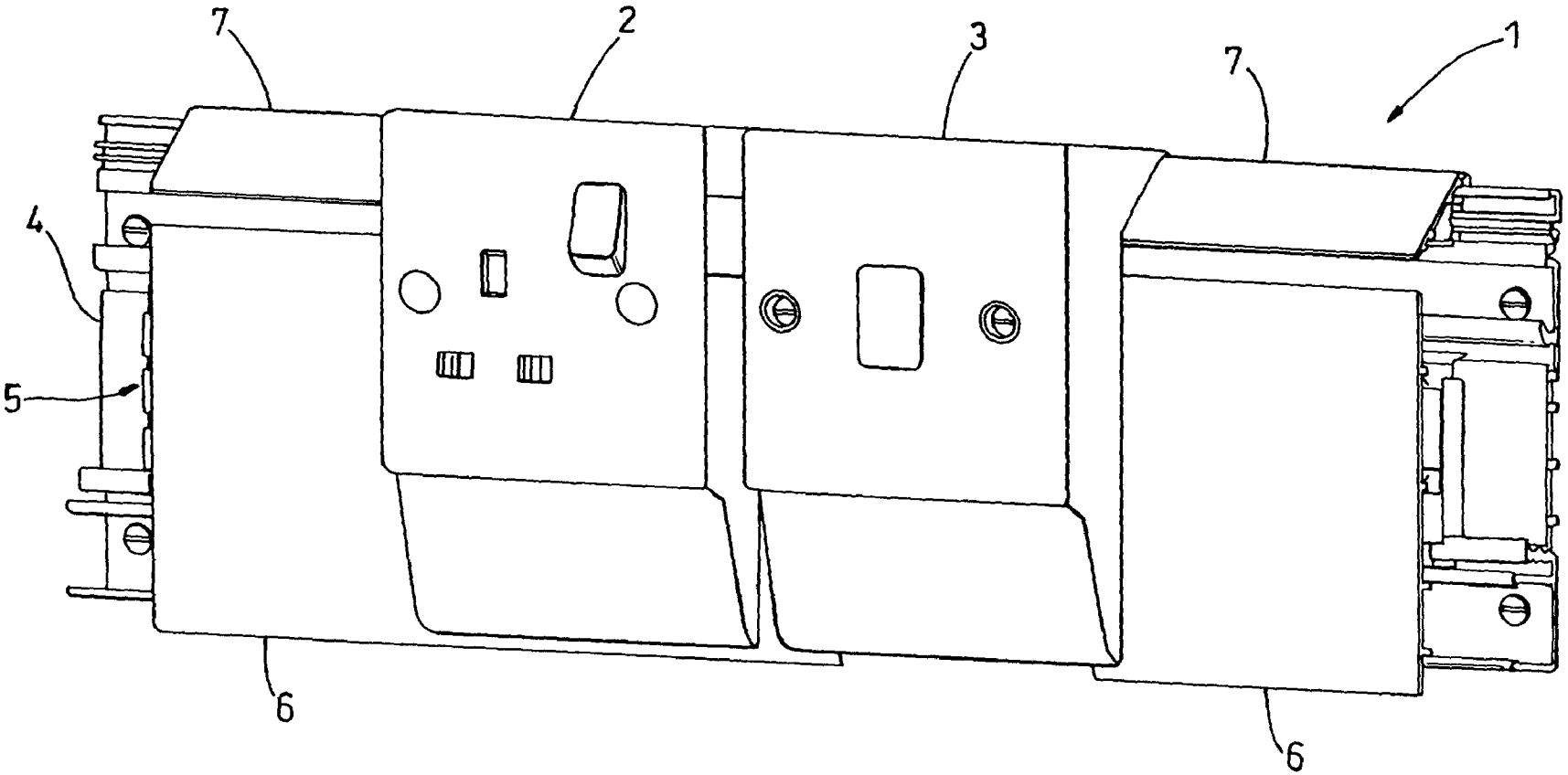

This application is a national stage entry of international application PCT/IB2004/004327, filed Dec. 6, 2004.

This invention relates to cable management and cabling systems for use in installations where electrical power, communication and data cabling is required, such as in offices, domestic housing and portable buildings.

It is known to provide dedicated trunking systems for cabling which is hidden from view, the outside of the trunking being disguised as e.g. skirting board around the perimeter of a room and having sockets for providing mains electrical power for use within the room, telephone and television receiving sockets and other data exchange sockets for e.g. modems. Such conventional trunking, whilst providing a neat and safe alternative to the use of individual wires to individual sockets placed on or in wall surfaces or even floor surfaces around the room, nevertheless suffer from a number of disadvantages, the first and most obvious being that once installed it is difficult to correct any faults which may arise or to add to or easily change the location of any given socket should the need arise. This problem is addressed in part in U.S. Pat. No. 6,309,229 which describes an electrical track and adaptor assembly in which the adaptor, or socket, can be moved linearly along an insulating track which carries e.g. three flexible linear electrical conductor tracks of generally "u-shape" in cross section, each adaptor or socket having "L" shaped connector pins which engage with a respective conductor track on the insulating track to provide mains power to the adaptor or socket by the latter being rotated about a generally horizontal axis with respect to an upright track e.g. wall mounted, so that the free ends of the pins come into electrical contact with the respective conductors, whereafter the adaptor/socket can be retained in place with snap-fit covers on either side of the insulating track, to thereby mimic the appearance of an adaptor or socket flush-fitted to e.g. a skirting board. As such, it is a relatively simple matter to thereafter change the location of the adaptors/sockets within a room to a preferred position by removing the snap-fit covers, rotating the adapters/sockets so that their electrical contacts become disengaged with the electrical conductor tracks, withdrawing them and thereafter repositioning them to a desired position, followed by cutting to length and fitting snap-fit covers in place so that no gap exists between adjacent adapters/sockets.

However, a disadvantage with this system is that the connector pins are adapted to rotate into and out of engagement with the electrical conductor tracks carrying the mains electricity. As such, they are regarded for safety standards purposes in many countries as being the equivalent of ordinary plugs which linearly plug into ordinary mains sockets by means of a push fit. Accordingly, in order to satisfy such safety standards the connection typically has to be tested to withstand e.g. 15,000 insertion and removal cycles without failure in order to achieve compliance therewith. In practice, this is difficult to achieve and may therefore mean that such a system has to be manufactured to very fine tolerances with the highest quality materials and at otherwise greater expense than may be practical.

The present invention is derived in part from the realisation that the convenience of a track cabling system for use with an electrical conductor track in which the adaptors or sockets can be easily moved from one position to another can still be achieved through the use of an alternative connection mechanism between the conductor track and the adaptor/socket, which does not require any rotation.

According to a first aspect of the invention there is provided an electrical distribution system comprising or including an insulating track for insulating an electrically conducting track connectable to an electric power supply, one or more electric power take off sockets, each for receiving in electrical contact therewith an electric plug when inserted therein, characterised in that the or each socket has electrical contacts engageable via a push fit with a carriage electrically connectable to the electrically conducting track, the carriage being adapted to be selectively positioned therealong, and means whereby the or each socket may be selectably locked in place along the electrically conductive track, thereby permitting positioning and re-positioning as required of said the or each electric power take off socket.

Preferably, the carriage is adapted to be slideable along the track, although it may instead simply be placed at an appropriate position along the track and thereafter secured thereto, or there may be discrete formations on or in the insulating track and/or the electrically conducting track permitting the placement of the carriage at a required position therealong. The carriage itself may also be permanently or semi-permanently secured to a respective power take off socket or a holder for such socket if the socket is supplied separately.

Conveniently, the carriage has locking formations co-operable with the insulating track and/or the electrically conducting track which are moveable between an open position in which the or each carriage is e.g. slideable therealong and a closed position in which respective actuating pins have been engaged therewith via a push fit, cam surfaces associated with said locking means and/or actuating pins enabling locking of the carriage with respect to the insulating track and electrically conducting track.

Conveniently, the or each power take off socket includes a corresponding socket for receiving an electric plug although, alternatively, the power take off socket may simply be provided with e.g. electrical contacts to which wires may be connected which lead to a socket into which a plug may be fitted, which socket may itself be adapted to be connectable directly to the power take off socket.

Preferably, the electrically conducting track is of generally flat or ribbon-like construction so that it may be wound on a reel and thereafter lengths thereof cut off as required. Preferably, the electrically conducting track is composed of a flexible insulating substrate of e.g. plastics on which are mounted one or more metallic or otherwise electrically conducting strips in generally parallel configuration, such as three strips of flat copper representing, respectively, mains positive, mains neutral and mains earth, the earth conductor preferably being positioned between the positive and neutral conductors.

Advantageously, the insulating track may include an insulating cover to prevent accidental access to the electrically conducting track after the electrical distribution system has been installed and may also include means for mounting other types of electrical sockets, such as sockets for use with telephones, televisions and data exchange sockets for e.g. modems, the wiring for which being stored within one or more dedicated conduits in the insulating track parallel to the main electrically conducting track.

In accordance with a second aspect of the invention, there is provided an insulating track for insulating an electrically conducting track connectable to an electric power supply, the insulating track including a guide rail or slot onto or into which is receivable a carriage, preferably slideable, for electrically connecting electrical contacts mountable on or in the insulating track with one or more primary sockets mountable by a push fit on or in the track. Conveniently, locking formations are provided co-operable with corresponding locking formations on or in the carriage when mounted thereto to thereby releasably lock the carriage in place. An insulating track may also be provided which includes a separate conduit for receiving additional wiring associated with the or each secondary socket.

In a third embodiment of the invention there is provided an electrically conducting track connectable to an electric power supply and adapted to be mounted on an insulating track, the electrically conducting track being adapted to receive electrical contacts associated directly or indirectly with an electrical socket, the electrically conducting track being of generally flat or ribbon-like construction and, preferably, windable on a reel. Conveniently, the electrically conducting track is composed of a flexible insulating substrate on which is mounted the electrically conducting track.

In a fourth embodiment of the invention there is provided a, preferably, slideable carriage electrically connectable to an electrically conducting track when mounted on an insulating track having guide means thereon along, the carriage also being connectable to an electric plug or adaptor by a push fit.

In a fifth embodiment of the invention there is provided an electric power take off socket for receiving in electrical contact therewith an electric plug when inserted therein or thereon, the electric power take off socket being adapted to be engageable with a carriage electrically connectable to an electrically conducting track mounted on an insulating track. Conveniently, the electric power take off socket includes means co-operable with the carriage when mounted on the insulating track to lock the carriage in place when the power take off socket is engaged therewith.

Conveniently, the means to lock the carriage in place comprises pins extending from the power take off socket, the pins being insertable within the carriage to bear up against cam surfaces on slideable locking tabs which thereafter engage with and lock against locking formations on or in the electrically conducting track and/or insulating track.

Conveniently, a data input and/or output box is also adapted to be received upon the insulating track.

Figure 2:
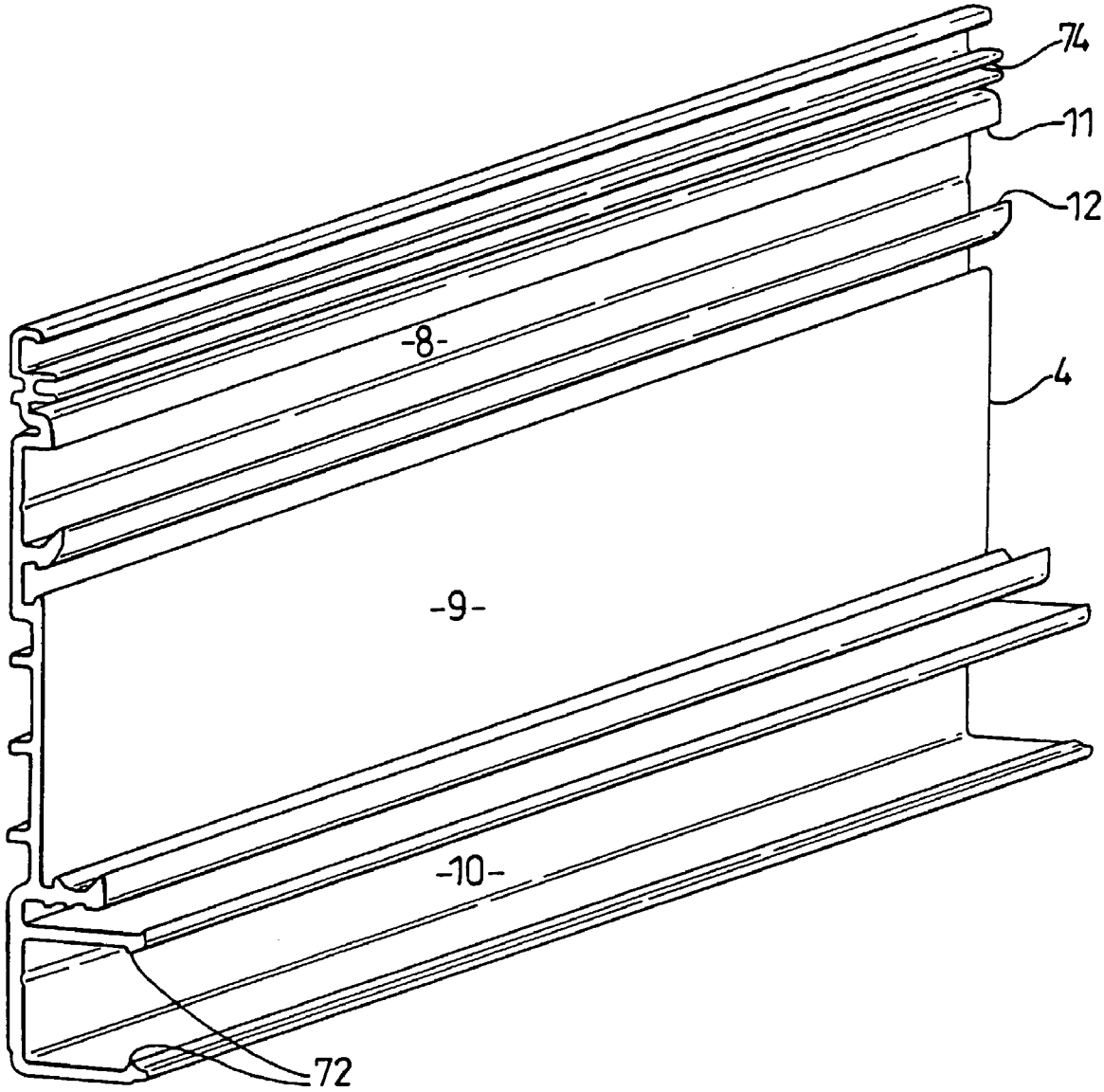
Figure 3:
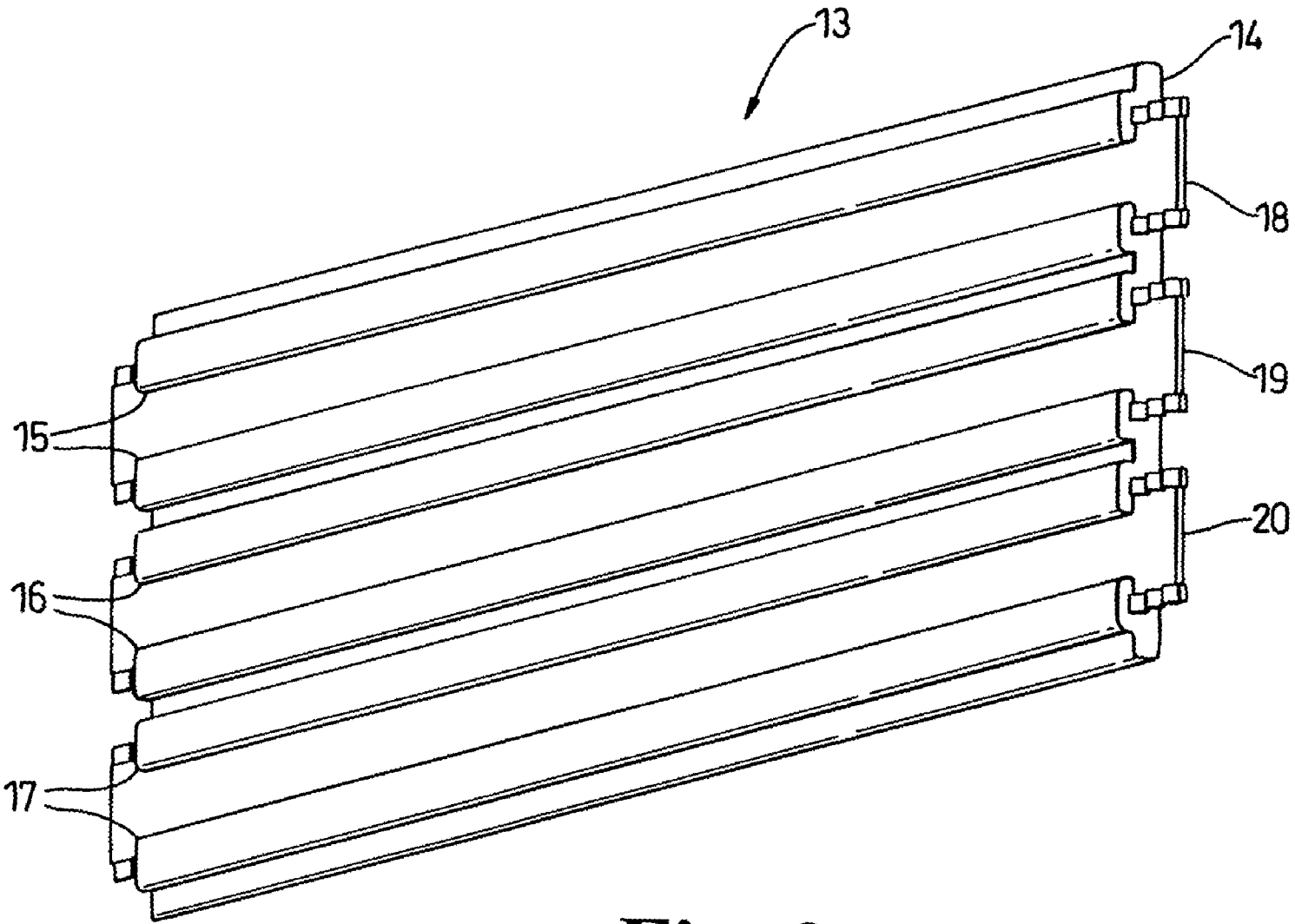
Figure 4:
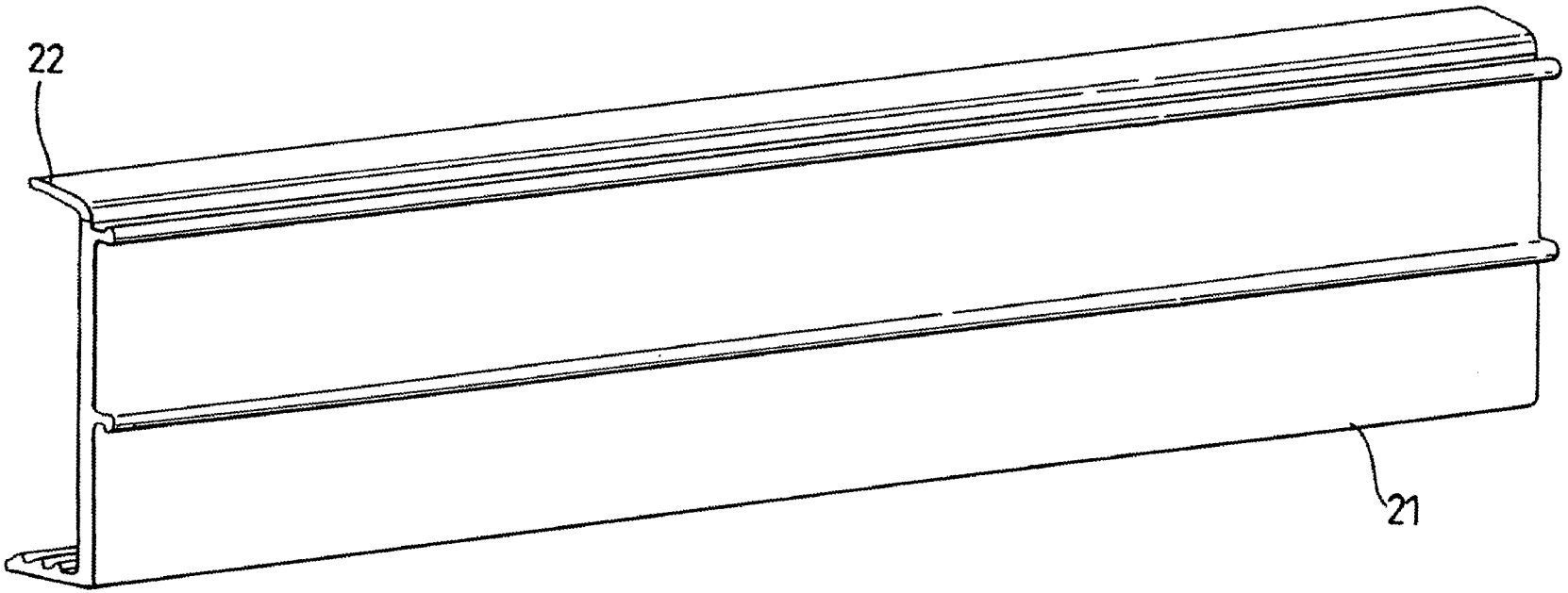
Figure 5:
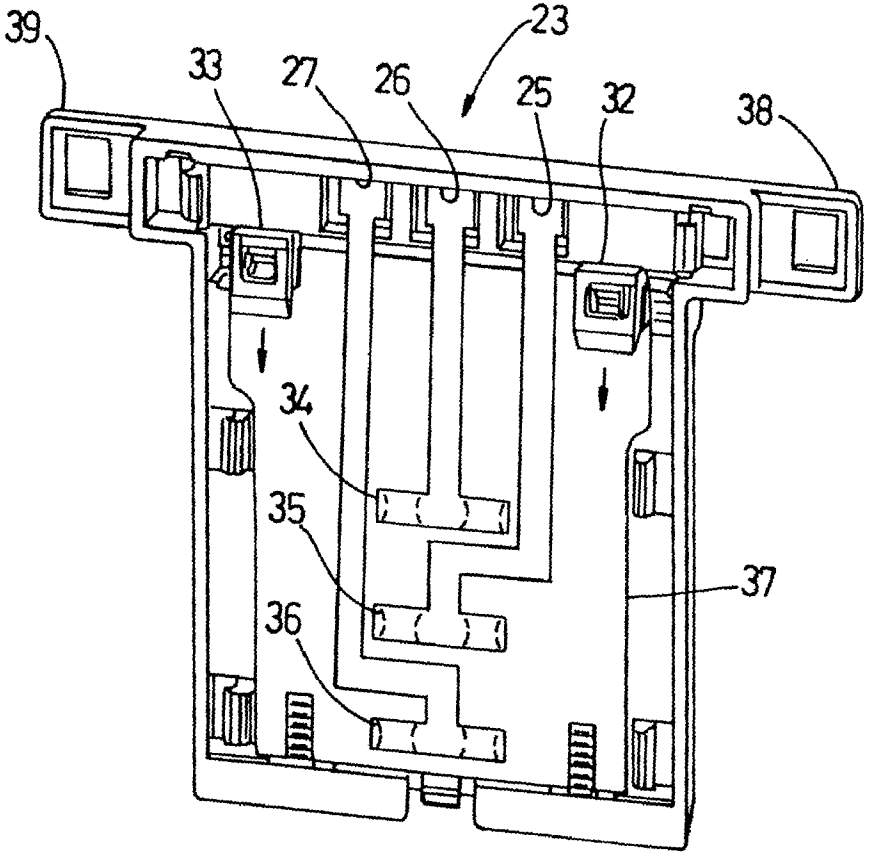
Figure 6:
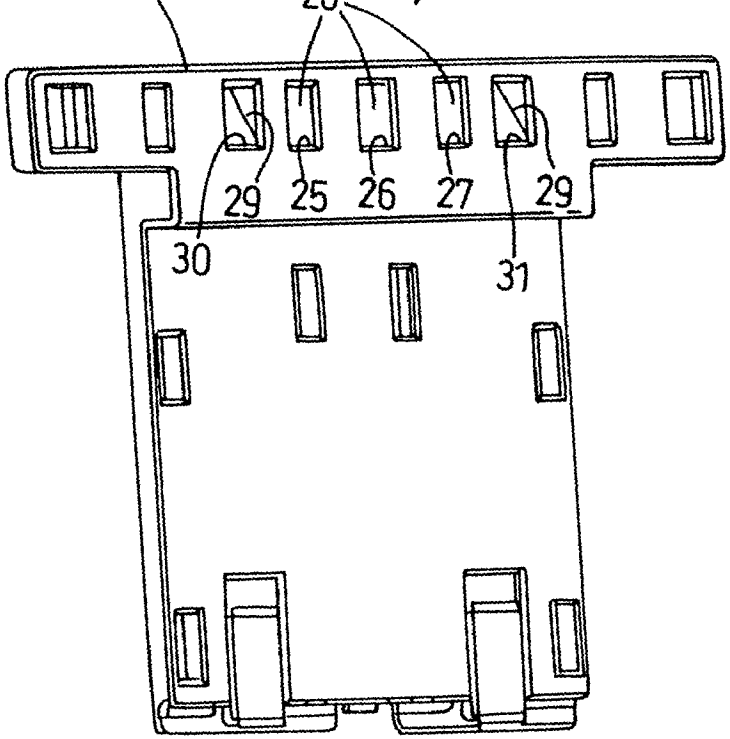
Figure 8:
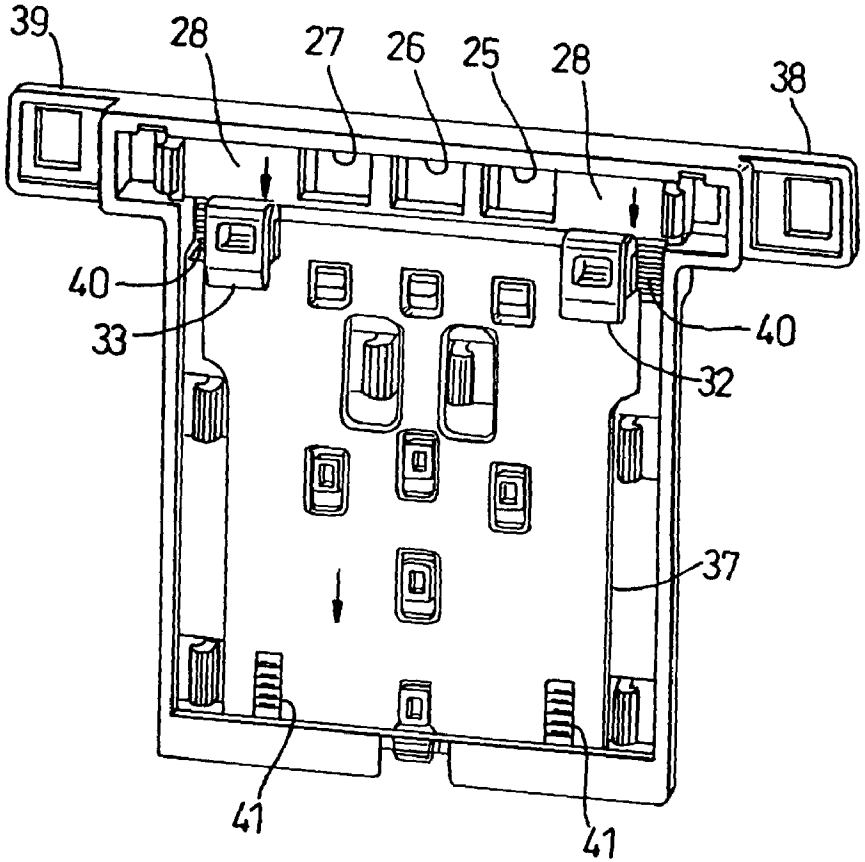
Figure 7:
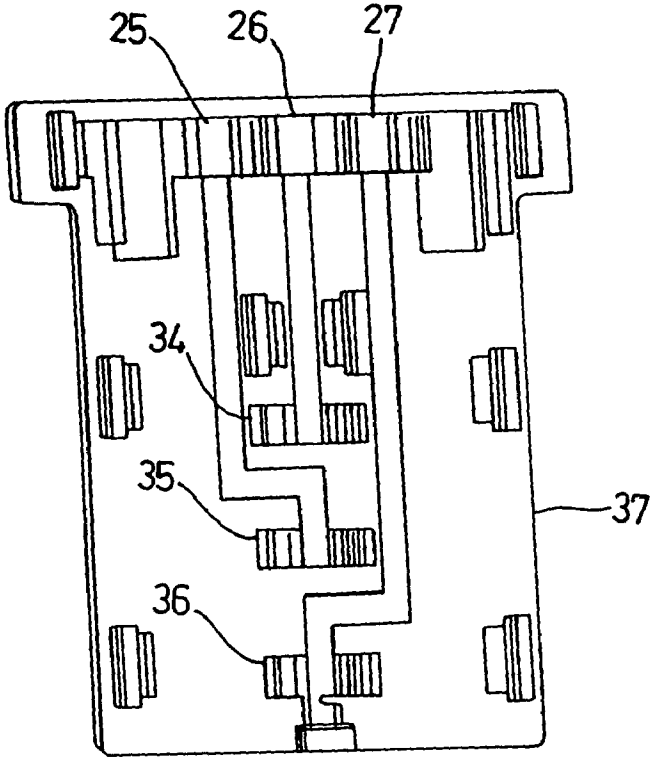
Figure 10:
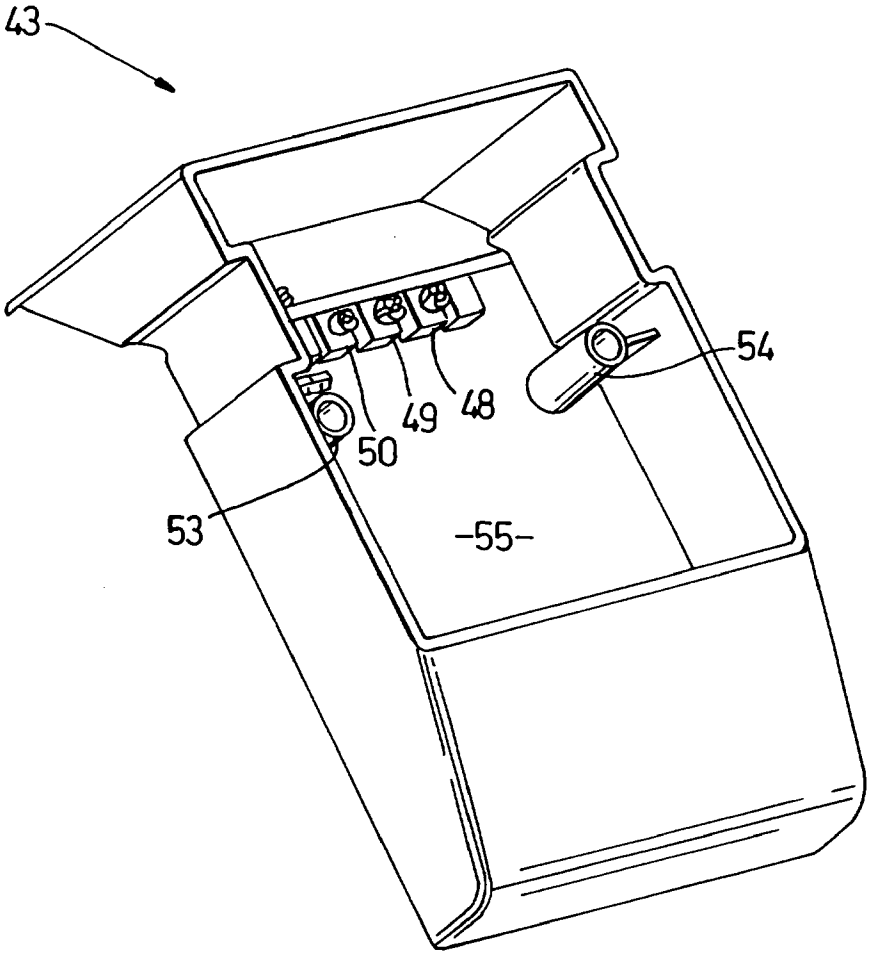
Figure 9:
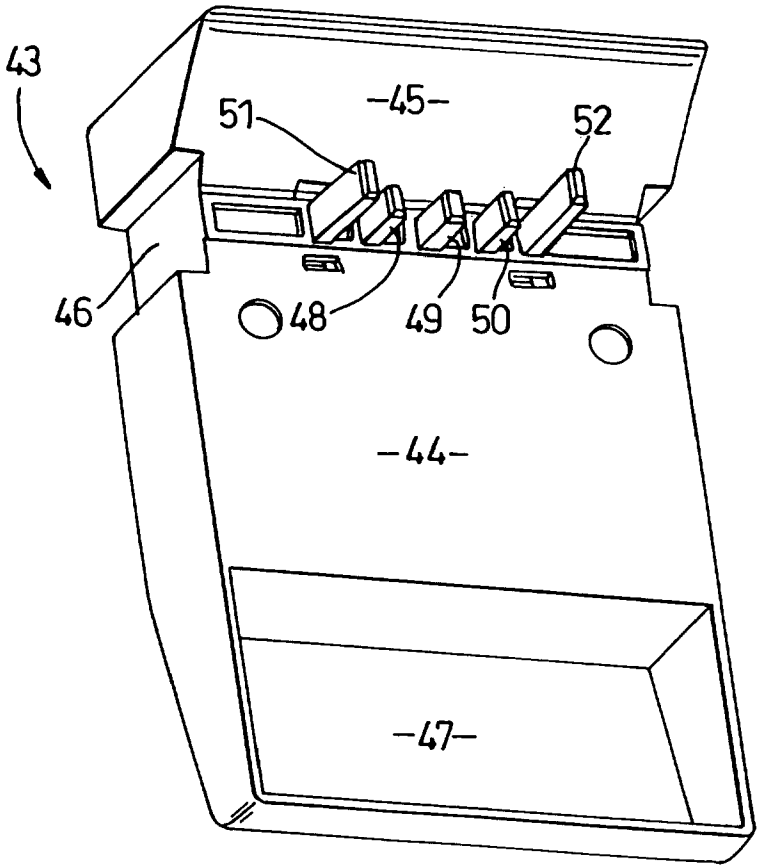
Figure 11:
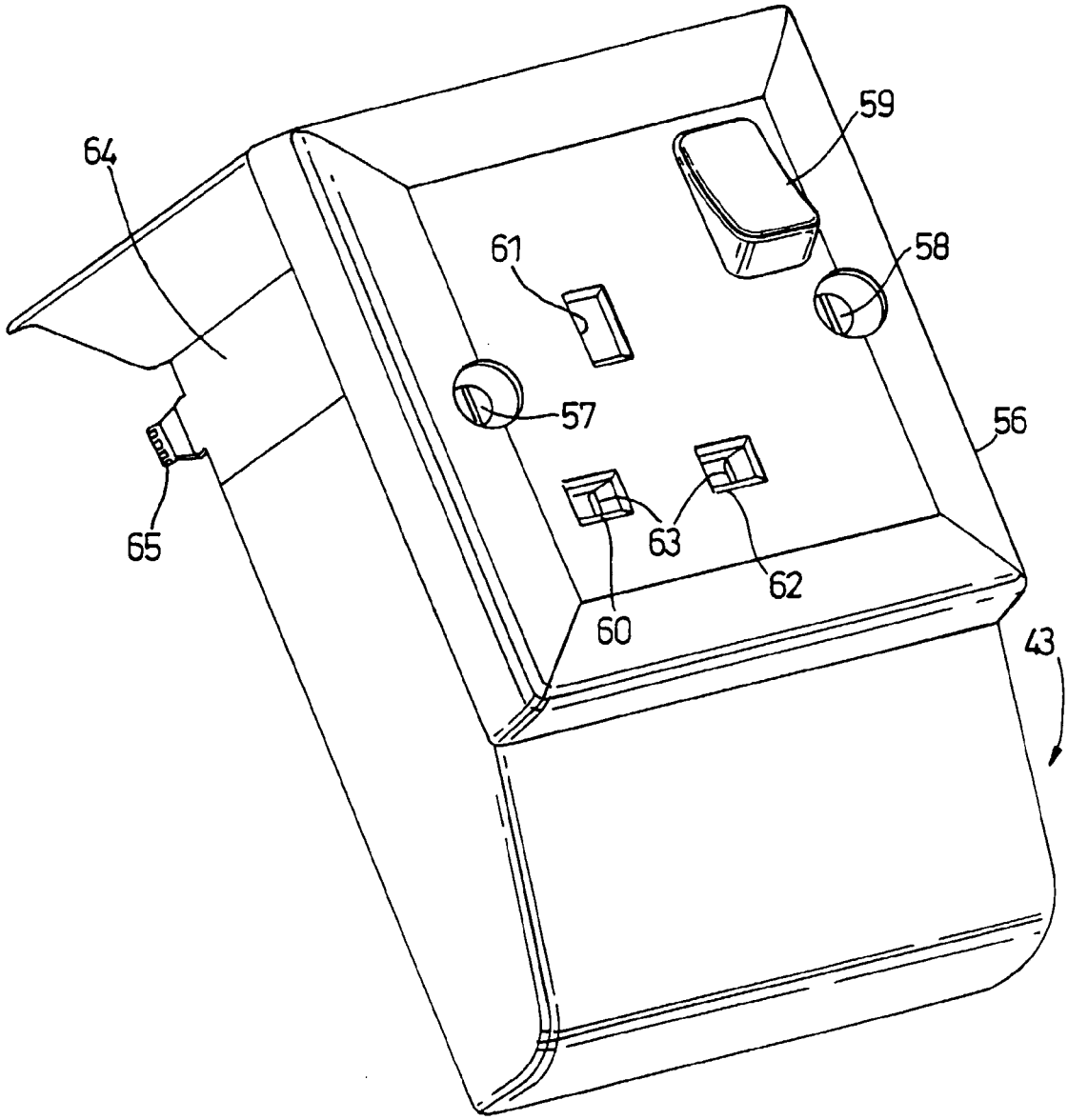
Figure 13:
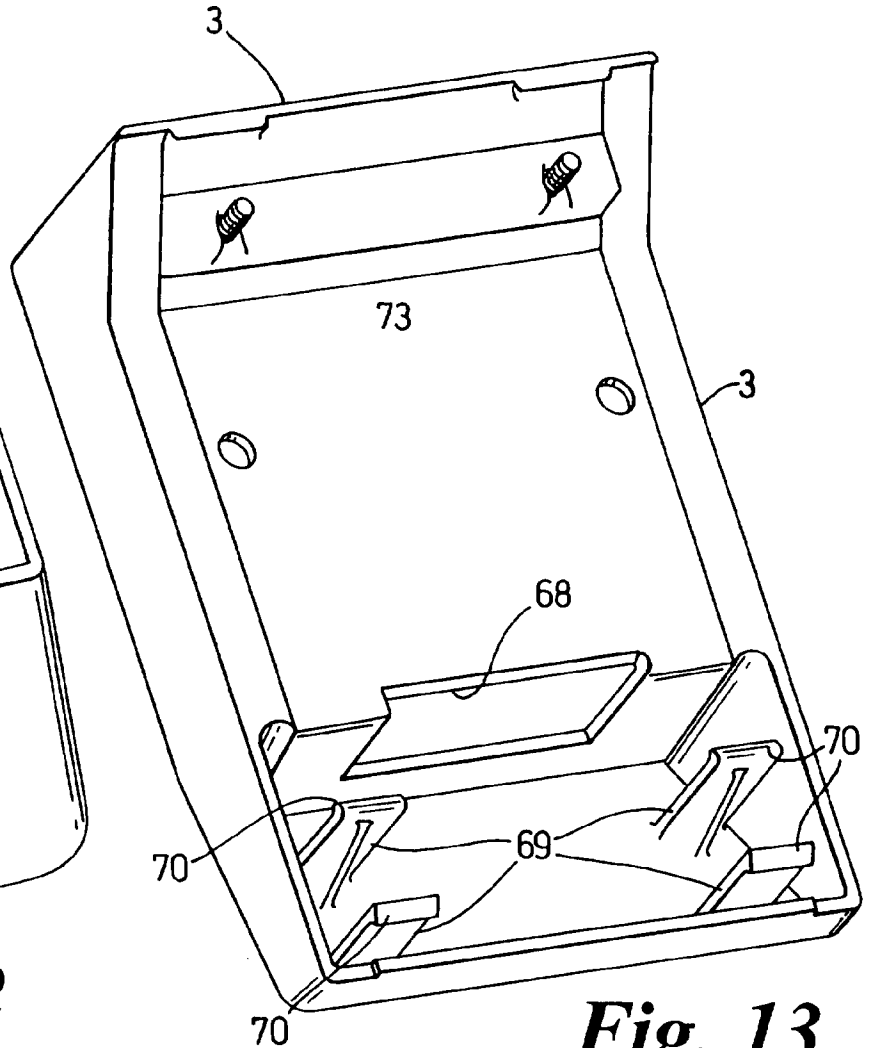
Figure 12:
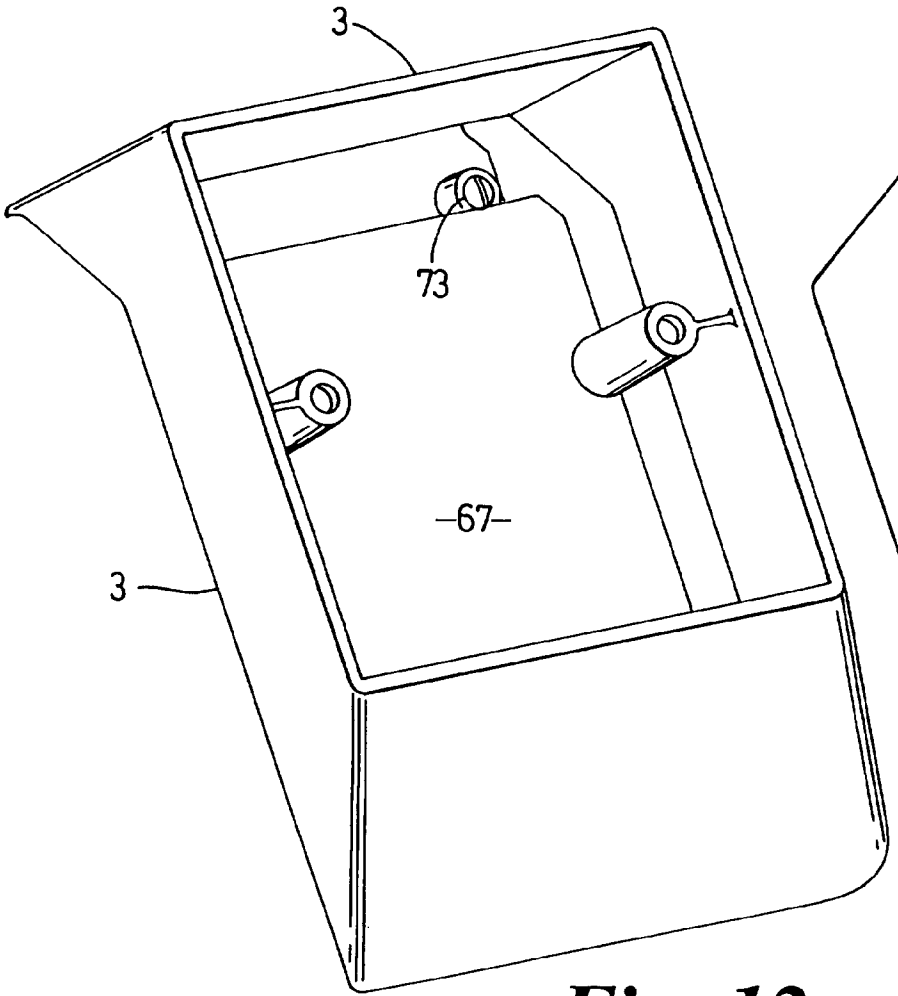
Figure 14:
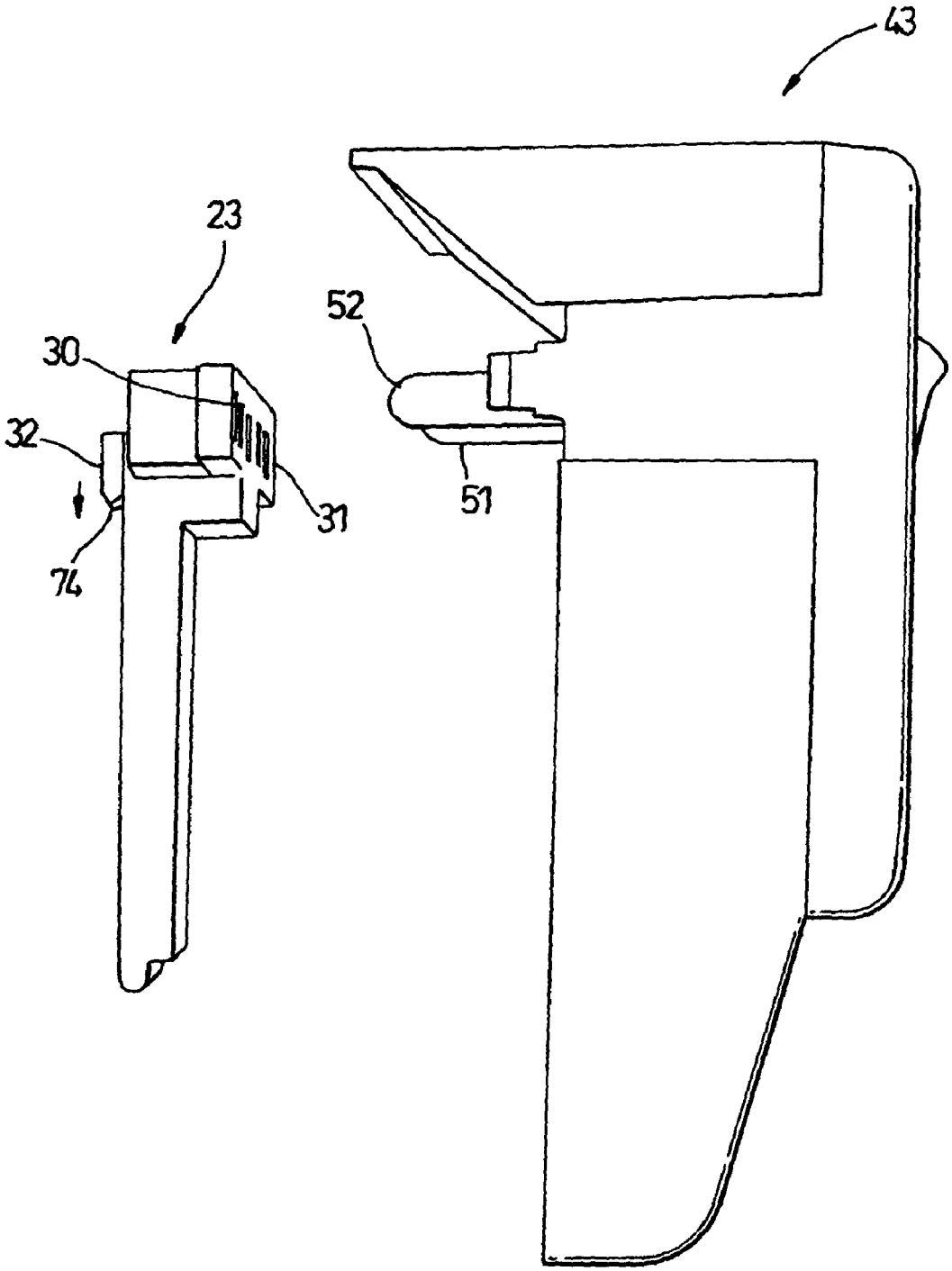
Figure 15:
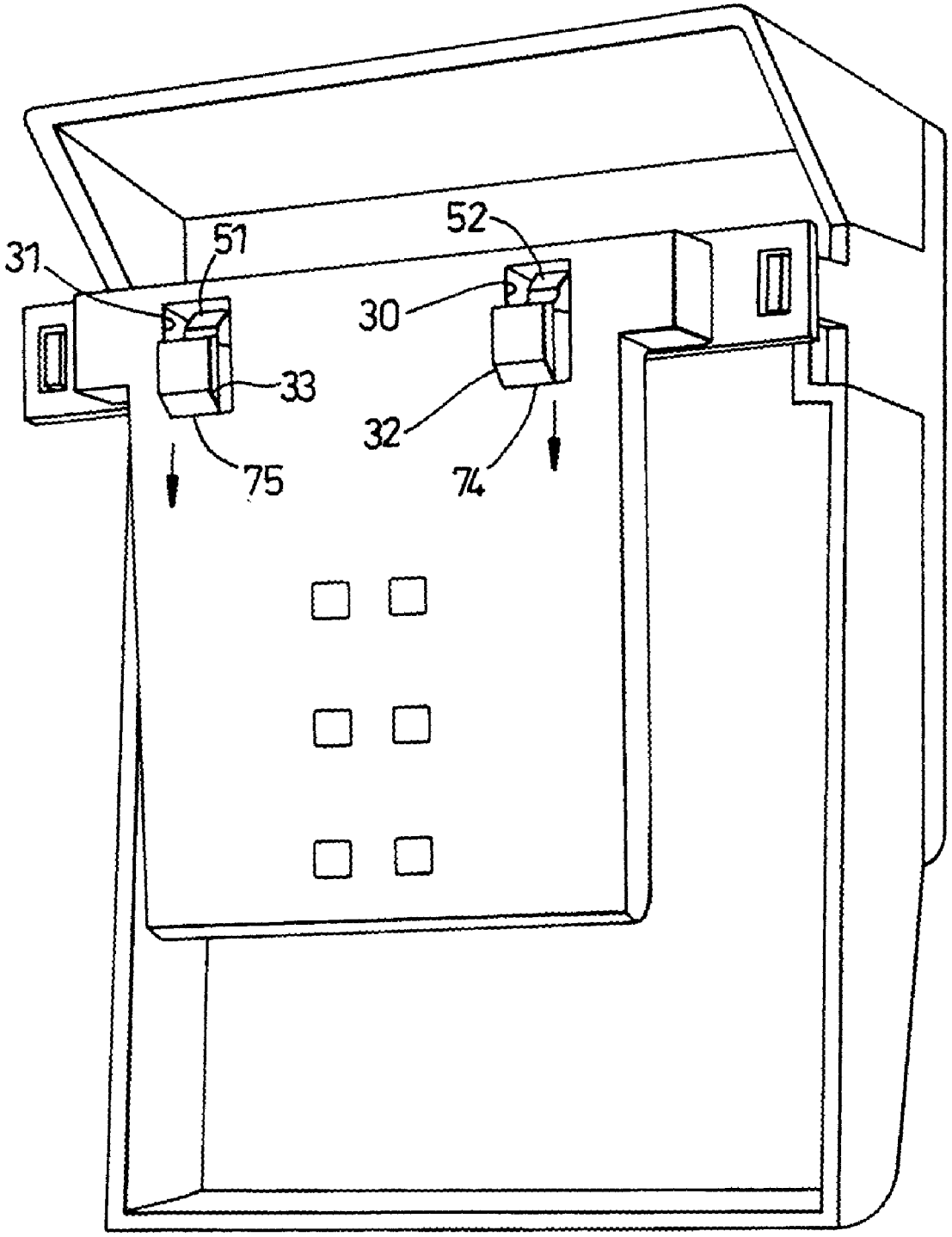
Figure 16:
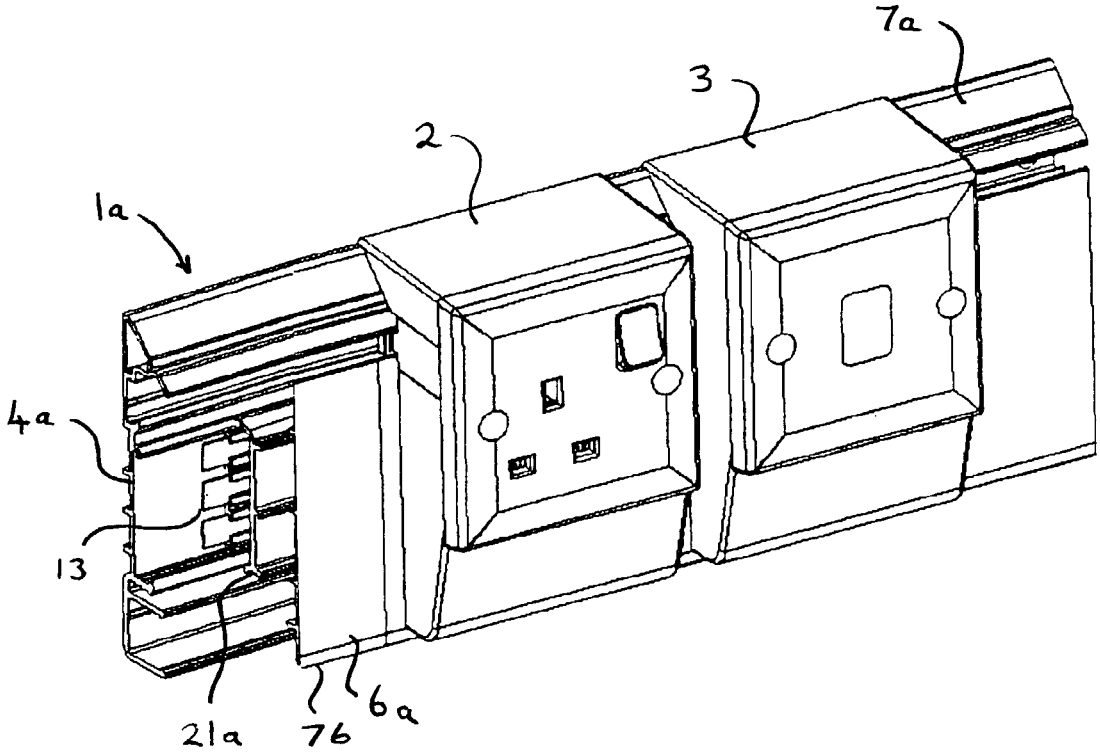
Figure 17:
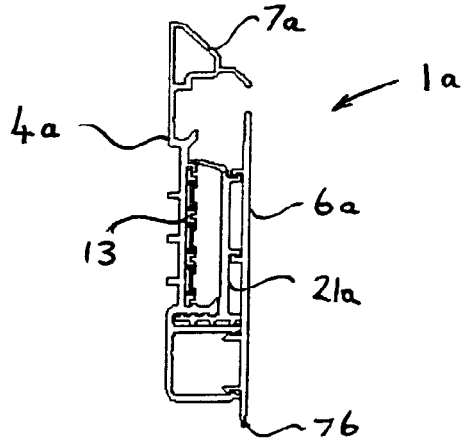

The invention will now be described, by way of example only, with reference to the accompanying drawings in which:

FIG. 1 is a general arrangement drawing of part of an electrical power distribution system in accordance with the invention, FIG. 2 is a perspective view of an insulating track base plate used in the system of FIG. 1, FIG. 3 is a perspective view of a conductor track and associated backing strip, FIG. 4 is a perspective view of an intermediate cover for the track of FIG. 3, FIG. 5 is a perspective top view the top half of a slideable carriage used in the system of the invention, FIG. 6 is a perspective underneath view of the half of the carriage of FIG. 5, FIG. 7 is a perspective inside view of the half of the carriage of FIG. 5, FIG. 8 is another perspective inside view of the half of the carriage of FIG. 5, FIG. 9 is a perspective underneath view of a primary electric power take off socket in accordance with the invention, FIG. 10 is a perspective top view of the power take off socket of FIG. 9, FIG. 11 is a perspective view of the power take off sockets of FIGS. 9 and 10 with a generally conventional mains socket mounted thereon, FIG. 12 is a perspective top view of a data outlet socket for use with the electrical distribution system of the invention with its front cover removed, FIG. 13 is a perspective underside view of the data outlet box of FIG. 12, FIG. 14 is an exploded side view of a power take off socket and associated slideable carriage showing the locking mechanism by which the carriage is locked to the insulating track (not shown), FIG. 15 is a perspective rear view of the power take off socket and associated slideable carriage of FIG. 14 in their partially assembled condition, FIG. 16 is a perspective view of a preferred embodiment of insulating track to that shown in FIG. 1 including primary and secondary sockets, and FIG. 17 is an end view of the insulating track of FIG. 16.

FIG. 1 is a general arrangement drawing of part of an electrical power distribution system comprising an insulating track shown generally at 1 for providing electrical power to a primary electric power outlet socket 2 and, optionally, for providing access cabling to a secondary socket 3 for connection to e.g. a telephone or television aerial. The insulating track 1 includes a track base plate 4 for mounting on e.g. a wall in substitution for skirting board and onto which is mounted a flexible electrically conductive track shown generally at 5 (only part of which can be seen), over which is disposed an insulating front cover 6. An inclined top cover 7 is also secured to the base plate 4, affording a gap between it and the front cover 6 through and into which electrical connector pins from the primary socket 2 may be inserted in a manner to be described.

In FIG. 2 the track base plate 4 is shown in more detail and comprises three main regions, a carriage receiving region 8, an electrical conductor track receiving region 9 and a secondary cable receiving region 10. The slideable carriage receiving region 8 has side walls 11, 12 of which part of the latter is inclined inwardly relative to the former, thereby defining a locking formation for a slideable carriage operable in a manner to be described.

In FIG. 3 there is shown an electrically conducting track shown generally at 13 which includes a flexible insulating substrate in the form of a backing strip 14 having insulating channels 15, 16 and 17, each for receiving respective strips of metal, e.g. copper, conductors 18, 19 and 20 representing, in sequence, mains positive, mains earth and mains neutral, respectively, although it will be understood that the particular sequence and use of each such conductor is dependent upon the requirements of the electrical distribution system.

As will be apparent, the electrically conducting track 13, being generally flat or ribbon-like, can therefore be mounted flush against the electrically conducting track receiving region 9 of the back plate 4 shown in FIG. 2 and retained thereon by any suitable means, such as e.g. locking strips co-operable with formations on the back plate 4 in order to releasably lock the flexible backing strip 14 in place. As will be further appreciated, an advantage of this configuration is that it is easily bent about its transverse axis relative to the major plane of the electrically conducting track 13 such that it is easily insertable within e.g. a slot representing a change of direction of the insulating track 1, for example through 90° if installed within a rectilinear room or office.

In FIG. 4 there is shown an intermediate cover 21 adapted to insulate the otherwise exposed electrically conducting track 13 and includes an integrally moulded flexible lip 22 so as to be deformable about a neck portion of a carriage electrically connected to the electrically conducting track 13 in a manner to be described.

Referring now to FIGS. 5 and 6 there are shown outside front and inside front views of one half of a slideable carriage 23 adapted to be electrically connected to the electrically conducting track 13 of FIG. 3 and to slide along the carriage receiving region 8 of the back plate 4 of FIG. 2. In FIG. 5 the carriage 23 has a head portion 24 which includes a set of three sockets 25, 26 and 27 into which may be inserted, in use, electrical contact pins from a primary electric power take off socket to be described. Each socket 25, 26 and 27 is covered by a shutter plate 28 spring biased to the position shown and being openable by virtue of having cam surfaces 29 at respective ends in register with shutter opening sockets 30, 31 into which can be inserted the correspondingly shaped leading ends of shutter opening pins 51, 52 (shown in FIGS. 9, 14 and 15) extending from the electric power take off socket to be described. When this happens they extend through the shutter opening sockets 30 and 31 and bear up against and cause slideable locking tabs 32, 33 (shown in FIG. 6) to move in the direction arrowed so as to engage with and lock against the locking formation 12 of the back plate 4 as shown in FIG. 2.

As shown in FIG. 6, respective pairs of electrical contacts 34, 35 and 36 extend from a slideable body portion or plate 37 of the slideable carriage 23 and which, in use, bear up against and make electrical contact with the corresponding electrical contacts 18, 19 and 20 of the flexible electrically conducting track 13 shown in FIG. 3, the contacts, 34, 35 and 36 extending within the body of the carriage 23 to the sockets 25, 26 and 27.

In order to allow for retention of an electric power take off socket on the slideable carriage 23 a pair of apertured ears 38, 39 are provided at opposite ends of the head portion 24, the apertures allowing for insertion of correspondingly shaped capture pins extending from an electric power take off socket in a manner to be described.

In FIGS. 7 and 8 are shown respective views of the slideable body portion or plate 37 and inside front of the slideable carriage 23, FIG. 7 showing in particular the arrangement of the electrical connection between the contacts 34, 35 and 36 through to their socket ends 25, 26 and 27.

In FIG. 8 is shown in more detail the manner in which the shutter 28 operates. The shutter 28 is biased to the closed position shown by springs 40 and can move in the direction arrowed following insertion of the pins of an electric power take off plug and associated shutter opening pins described with reference to FIGS. 9 and 10, shutter 28 being moved to thereby open the sockets 25, 26 and 27.

Similarly, slideable body portion 37 and hence its respective locking tabs 32, 33, is biased to the position shown by springs 41 and may move in the direction arrowed in a manner to be explained with reference to FIGS. 14 and 15.

FIG. 9 shows the underside view of an electric power take off socket shown generally at 43 having a central body portion 44, a head portion 45, a neck portion 46 and a bottom cover 47 adapted to, in use, cover the secondary cable receiving conduit 10 shown in FIG. 2. Extending from the neck portion 46 are respective electrical contact pins 48, 49 and 50 shaped to be insertable within the contact sockets 25, 26 and 27 of the slideable carriage 23 shown in FIGS. 5 to 8. Also extending from this neck region 46 of the socket 43 are a pair of longer shutter actuating pins 51, 52, the free ends of which have cam surfaces by which they may bear up against correspondingly shaped cam surfaces 29 on the shutter 28 (shown in FIG. 5) to thereby cause it to open against the bias of the springs 40.

FIG. 10 shows the outside view of the socket 43 and it will be seen that the ends of the contact pins 48, 49 and 50 are provided with screws with associated apertures into which individual wires may be inserted e.g. mains positive, mains earth and mains neutral wires which may thereafter be connected to a generally conventional socket plate (not shown) mountable on hollow studs 53, 54 extending from and within a hollow cavity 55 defined substantially by the walls of the electric power take off socket 43.

In FIG. 11 a generally conventional mains socket 56 is shown mounted on and in the cavity 55 of the power take off socket 43 via screws 57, 58 driven therethrough and into respective studs 53, 54 as shown in FIG. 10. The socket 56 includes an on-off switch 59 and socket terminals 60, 61 and 62, of which terminals 60 and 62 are covered by a respective shutter 63 when not in use i.e. in the condition shown. Although thus far conventional, the socket 56 nevertheless includes in accordance with this embodiment of the invention a pair of oppositely disposed side wings 64 (only one of which is shown) terminating in flexible angled tongue 65, each insertable within the gap afforded by the apertured ears 38, 39 of the carriage 23 shown in FIGS. 5 and 6.

In FIGS. 12 and 13 there are shown respective front and rear views of the data outlet box 3 as shown in FIG. 1 but with its front cover removed to reveal a cavity 67 into which may extend wires to or from the secondary cable receiving region 10 of the track 4 through the use of an access window or aperture 68 shown in FIG. 13. The data box 3 also includes bendable fingers 69 having hook formations 70 at their extremities, which hook formations 70 are received, in use, behind corresponding lipped portions 72 of the secondary cable receiving region or conduit 10 in the track 4 to initially be snap-fitted into place, followed by a more secure fixing through the use of screws 73 at the opposite end of the data box 3 securable into a correspondingly sized slot 74 in the back plate or track 4 of FIG. 2.

In FIGS. 14 and 15 there is shown in more detail the mechanism by which the power take off socket 43 cooperates with the slideable carriage 23 to lock the latter in position on the track base plate 4 so that its electrical contacts 34, 35 and 36 tightly engage with the copper conductors 18, 19 and 20 on the electrically conducting track 13 (not shown). In FIG. 14, the power take off socket 43 is shown disengaged relative to the slideable carriage 23 and the shutter opening pins 51, 52 are axially aligned with the shutter opening sockets 30, 31 in the slideable carriage 23. Extending outwardly from the opposite side of the slideable carriage 23 are the pair of locking tabs 32, 33 (best seen with reference to FIG. 15) which are slideable in the direction arrowed against a spring bias as explained with reference to FIGS. 6 and 8. Accordingly, as the inclined leading ends of the shutter opening pins 51, 52 proceed past the cam surfaces 29 on the shutter plate 28 (shown in FIG. 5) to open the shutter plate 28 they engage with the edges of the locking tabs 32, 33 to thereafter upon further insertion of the power take off socket 43 into the shutter opening sockets 30, 31 cause the tabs 32, 33 to move in the direction arrowed. As will be appreciated, when this action occurs with the slideable carriage 23 positioned on the track base 4 directly over the electrically conducting track 13 the angled leading edges 74, 75 engage behind the locking formation 12 on the track 4 (shown in FIG. 2) to thereafter firmly lock the slideable carriage 23 thereagainst.

In a further refinement to the invention, separate locking means may be provided on or in the exposed electrical distribution system to ensure that, when installed, e.g. children cannot accidentally or deliberately gain access to any electrically live parts. In particular, locking means such as screws, pins or catches may be incorporated on or in the primary outlet socket 2 in order to prevent it from being easily removed, although it will be understood that should this happen the shutter 28 and the intermediate cover 21 combine to prevent direct access to any electrically live parts.

Although the carriage 23 shown in the preferred embodiment of the invention is intended to be slideable along the track base plate 4 and associated electrically conductive track 5 when the primary electric power take off socket is removed, partially or wholly, nevertheless it will be understood that the carriage 3 may itself simply be adapted to be fixed at any given point along the insulating track 1 at any desired position by e.g. traditional fasteners, or instead the insulating track 1 may incorporate discrete formations, such as projections and/or recesses, to which the carriage 23 may be secured.

Similarly, although in a preferred embodiment of the invention the power take off socket 43 incorporates its own mains socket 56 as shown in FIG. 11, nevertheless this may be provided as a separate item and in particular the hollow cavity 55 of the power take off socket 43 may be shaped to receive conventional mains sockets which may e.g. be sourced separately from the rest of the electrical distribution system of the invention.

Turning now to FIGS. 16 and 17 there are shown respective perspective and end views of a preferred embodiment of insulating track shown generally at 1*a* together with a primary electric outlet socket 2 and secondary socket 3, for example a telephone outlet. The insulating track 1*a* in this preferred embodiment comprises only four components, a track base plate 4*a* which includes an integrally moulded inclined top cover 7*a*, an electrically conducting track 13 corresponding to that shown in FIG. 3, an intermediate cover 21*a* adapted to insulate the electrically conducting track 13 and a front cover 6*a*. In this embodiment the front cover 6*a* also includes an integrally moulded flexible lip 76 intended to abut a floor surface, such as a carpeted surface, to thereby provide a gap-free junction between the floor and the insulating track 1*a*. It will therefore be seen that in this embodiment the track 1*a* and associated sockets 2, 3 can be easily assembled and disassembled with relatively few parts and the sockets 2, 3 moved along the track 1*a* as required with replacement or re-cut intermediate or front covers 21*a*, 6*a* as required.

The invention claimed is:

1. An electrical distribution system comprising or including an insulating track, an electrically conducting track electrically insulated by said insulating track and being connectable to an electric power supply, one or more primary electric power take off sockets for receiving in electrical contact therewith an electric plug when inserted therein, and at least one carriage for electrically connecting the track to a respective power take off socket, the at least one carriage being electrically connectable to said respective power take off socket by means of electrical contacts engageable via a push fit said at least one carriage being electrically connectable to the electrically conducting track by means of further contacts and said at least one carriage being adapted to be selectively positioned therealong, said at least one carriage also including locking means whereby said respective socket may be selectively locked in place along the electrically conductive track, thereby to position and reposition as required said respective socket, the system being characterised in that said respective socket cooperates with said at least one carriage to lock said at least one carriage in position on the insulating tract to thereby releasably lock said at least one carriage in place.

2. An electrical distribution system as claimed in claim 1 further characterised in that said respective socket includes actuating pins insertable into said at least one carriage for causing locking of the at least one carriage on the insulating track.

3. An electrical distribution system according to claim 1 or 2 further characterised in that the at least one carriage is slideable on the track when not locked in place thereon.

4. An electrical distribution system according to claim 3 further characterised in that the locking means is moveable between an open position in which the at least one carriage is slideable therealong and a closed position in which the actuating pins extending from the respective socket and engage therewith via a push fit.

5. An electrical distribution system according to claim 4 further characterised in that cam surfaces associated with said locking means and/or actuating pins enable slideable movement of the locking means of the carriage with respect to the insulating track and electrically conducting track to thereby releasably lock the carriage and the socket in place.

6. An electrical distribution system according to claim 5 further characterised in that each power take off socket includes a corresponding socket part for receiving the electric plug.

7. An electrical distribution system according to claim 3 further characterised in that the electrically conducting track is of generally flat and/or ribbon like construction.

8. An electrical distribution system according to claim 7 further characterised in that the electrically conducting track is composed of a flexible insulating substrate of e.g. plastics on which is mounted the electrically conducting track.

9. An electrical distribution system according to claim 3 further characterised in that the insulating track includes an insulating cover to prevent accidental access to the electrically conducting track after the electrical distribution system has been installed.

10. An electrical distribution system according to claim 8 further characterised in that the system includes means for mounting secondary sockets thereon, including sockets for use with telephones, televisions and data exchange sockets, including modems, the wiring for which being stored within one or more dedicated conduits in the insulating track parallel to the electrically conducting track.

11. An electrical distribution system according to claim 3 further characterised in that each power take off socket is provided with electrical contacts to which wires may be connected leading from a secondary outlet socket into which the electric plug may be inserted.

* * * * *